US006547623B1

(12) United States Patent
Collado

(10) Patent No.: US 6,547,623 B1
(45) Date of Patent: Apr. 15, 2003

(54) ILLUMINATED FLYING DISK WITH THREE CONCENTRIC RINGS OF CONTROLLABLE LIGHTS

(76) Inventor: Manuel Collado, 65 E. Gunhill Rd., Apt. 33, Bronx, NY (US) 10467

( * ) Notice: Subject to any disclaimer, the term of this patent is extended or adjusted under 35 U.S.C. 154(b) by 0 days.

(21) Appl. No.: 10/215,823

(22) Filed: Aug. 9, 2002

(51) Int. Cl.[7] ..... A63H 27/00
(52) U.S. Cl. ..... 446/47; 446/46; 473/570
(58) Field of Search ..... 446/34, 46, 47, 446/484, 485, 219; 473/570, 588; 244/12.2, 23 C

(56) References Cited

U.S. PATENT DOCUMENTS 4,248,010 A * 2/1981 Fox ..... 446/47
4,254,575 A * 3/1981 Gould ..... 446/46
4,435,917 A 3/1984 Lee ..... 46/228
4,778,428 A * 10/1988 Wield ..... 446/47
5,032,098 A 7/1991 Balogh et al. ..... 446/47
5,083,799 A * 1/1992 Thill ..... 473/588
5,290,184 A 3/1994 Balogh et al. ..... 446/47
5,319,531 A * 6/1994 Kutnyak ..... 362/184

* cited by examiner

*Primary Examiner*—Jacob K. Ackun
*Assistant Examiner*—Bena B. Miller
(74) *Attorney, Agent, or Firm*—Goldstein & Lavas

(57) ABSTRACT

An illuminated flying disk with three concentric rings located on its upper surface, each ring made up of a plurality of independently addressable individual light bulbs which enables it to be seen even under low ambient lighting conditions. The bottom surface of the disk has a centrally located battery housing unit for holding the batteries and a control unit. Adjacent to the battery storage unit is an on/off switch and a mode selector which allows a choice of three settings for the light display system. The first setting provides for constant emission of light from all bulbs at all times. The second setting provides for a lighting effect which entails sequential lighting of adjacent individual bulbs located on each ring, thereby imparting an illusion of moving light around the ring. The third setting allows for alternate flashing between successive rings. By choosing one of the three settings, the user determines which visual effect to enable.

5 Claims, 3 Drawing Sheets

10

ILLUMINATED FLYING DISK WITH THREE CONCENTRIC RINGS OF CONTROLLABLE LIGHTS

BACKGROUND OF THE INVENTION

1. Field of the Invention

The present invention relates to an illuminated flying disk which has rings of controllable battery-operated lights on its upper surface which may be illuminated in various configurations to allows the disk to be easily seen and used for recreational purposes even when it is dark outside.

2. Description of the Related Art

Several references uncovered in the search show various flying disks which have battery-operated lights associated with them. U.S. Pat. No. 5,032,098 to Balogh appears to show an illuminated flying disk comprised of a plurality of lights that are controlled using a circuit and switch on the underside of the device to provide a strobe effect. However, this disk does not appear to provide any variation in the lighting sequence which might provide for a more aesthetically pleasing and less monotonous display.

U.S. Pat. No. 5,290,184 to Balogh appears to show an illuminated flying disk with two opposed housings having a battery and lights carefully situated to equally distribute the weight for improved stability. However, this disclosure pertains primarily to the placement of the housings to optimize aerodynamic stability.

U.S. Pat. No. 5,319,531 to Kutnyak appears to show an illuminated flying disk with means to control a plurality of integral high intensity light sources. However, Kutnyak appears to contemplate placement of lights inside of a translucent disk, thereby imparting a glowing effect throughout the disk body.

U.S. Pat. No. 4,435,917 to Lee appears to show an illuminated flying disk with a number of incandescent lamps that are capable of flashing at shorter intervals when the disk is in motion. However, Lee is addressed primarily to varying the pulse rate with varying spin rate of the disk.

While these units may be suitable for the particular purpose employed, or for general use, they would not be as suitable for the purposes of the present invention as disclosed hereafter.

SUMMARY OF THE INVENTION

It is an object of the invention to produce an illuminated flying disk which can be used for recreational purposes even when the level of ambient light is extremely low. Accordingly, this invention is a flying disk which has battery-operated lights associated with its surface thereby allowing it to be easily seen even when it is very dark outside.

It is a further object of this invention to provide a user with a variety of visual effects. Accordingly, when the battery-operated lighting system is employed, the user has a choice of three settings, each which provides its own interesting visual effects by controlling the illumination of the individual lights according to various predetermined functionalities.

It is a further object of this invention to provide a toy which can be easily used during daylight conditions as well as during nighttime. Accordingly, this flying disk is equipped with an on/off switch to allow the user to choose battery operated lighting if appropriate under the prevailing light conditions, or to switch off the battery operated lighting if unnecessary.

It is a further object of this invention to provide a device which is aesthetically pleasing to the viewer. Accordingly, the unit which controls the lighting effects and the batteries are located on the bottom portion of the flying disk and therefore they are not as readily seen when the disk is in motion.

It is a further object of this invention to provide a flying disk which is aerodynamically stable in spite of the associated battery-operated lighting system. Accordingly, the control system is centrally located on the bottom surface and does not effect the symmetry of the disk.

The invention is an illuminated flying disk with three concentric rings located on its upper surface, each ring made up of a plurality of independently addressable individual light bulbs which enables it to be seen even under low ambient lighting conditions. The bottom surface of the disk has a centrally located battery housing unit for holding the batteries and a control unit. Adjacent to the battery storage unit is an on/off switch and a mode selector which allows a choice of three settings for the light display system. The first setting provides for constant emission of light from all bulbs at all times. The second setting provides for a lighting effect which entails sequential lighting of adjacent individual bulbs located on each ring, thereby imparting an illusion of moving light around the ring. The third setting allows for alternate flashing between successive rings. By choosing one of the three settings, the user determines which visual effect to enable.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
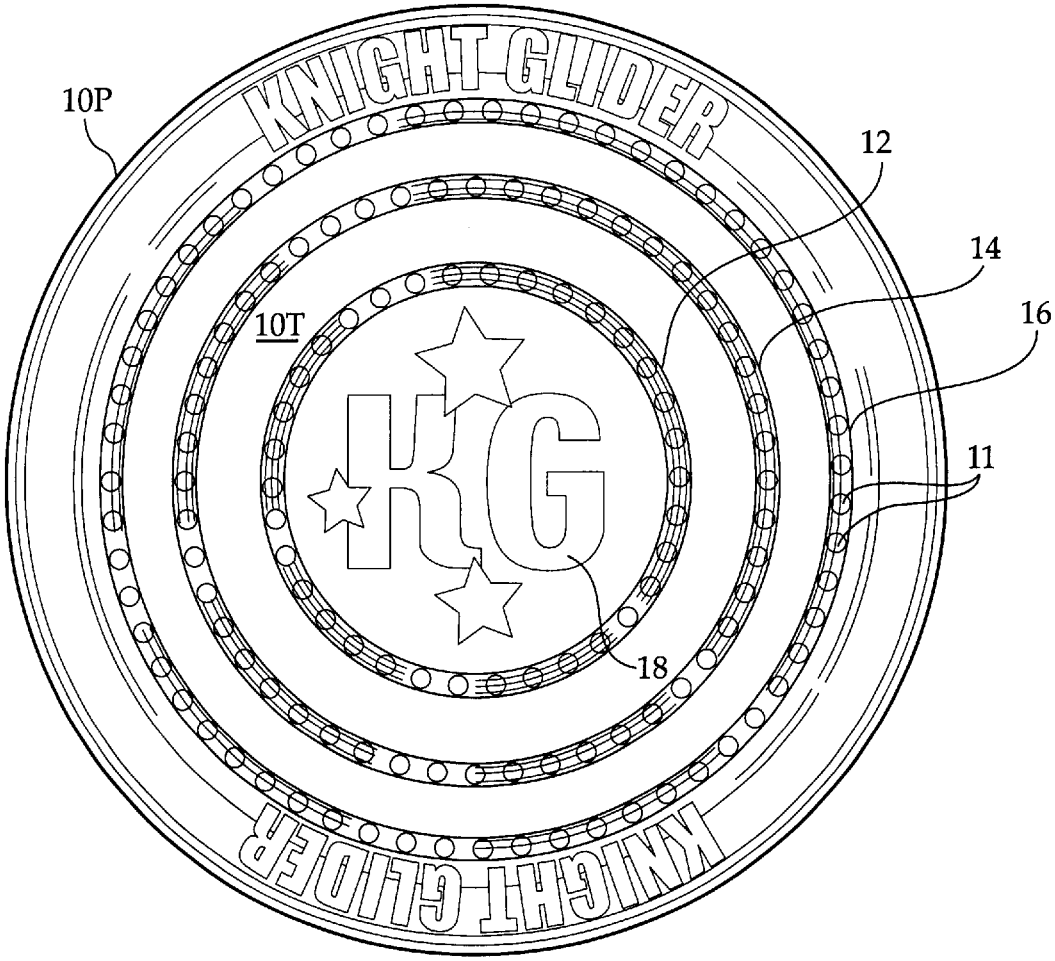
FIG. 1 is a top view of the invention which indicates the placement of the three concentric rings of light bulbs.

FIG. 1 illustrates a top view of a flying disk 10, which is substantially round, having a top surface 10T, a peripheral edge 10P and a center. Indicia 18, located in the central portion of the top surface, may be used to indicate the brand name of the flying disk, or may be personalized to the user. Three rings, each made up of a plurality of individual independently addressable light bulbs 11 are located on the top surface 10T, are concentric with the peripheral edge 10P, and are concentric with each other. The three rings include a first ring of lights 12, located closest to the center of the disk 10; a second ring of lights 14 located outside of the first ring of lights 12; and a third ring of lights 16 located furthest from the center of the disk and closest to its peripheral edge 10P.

Figure 2:
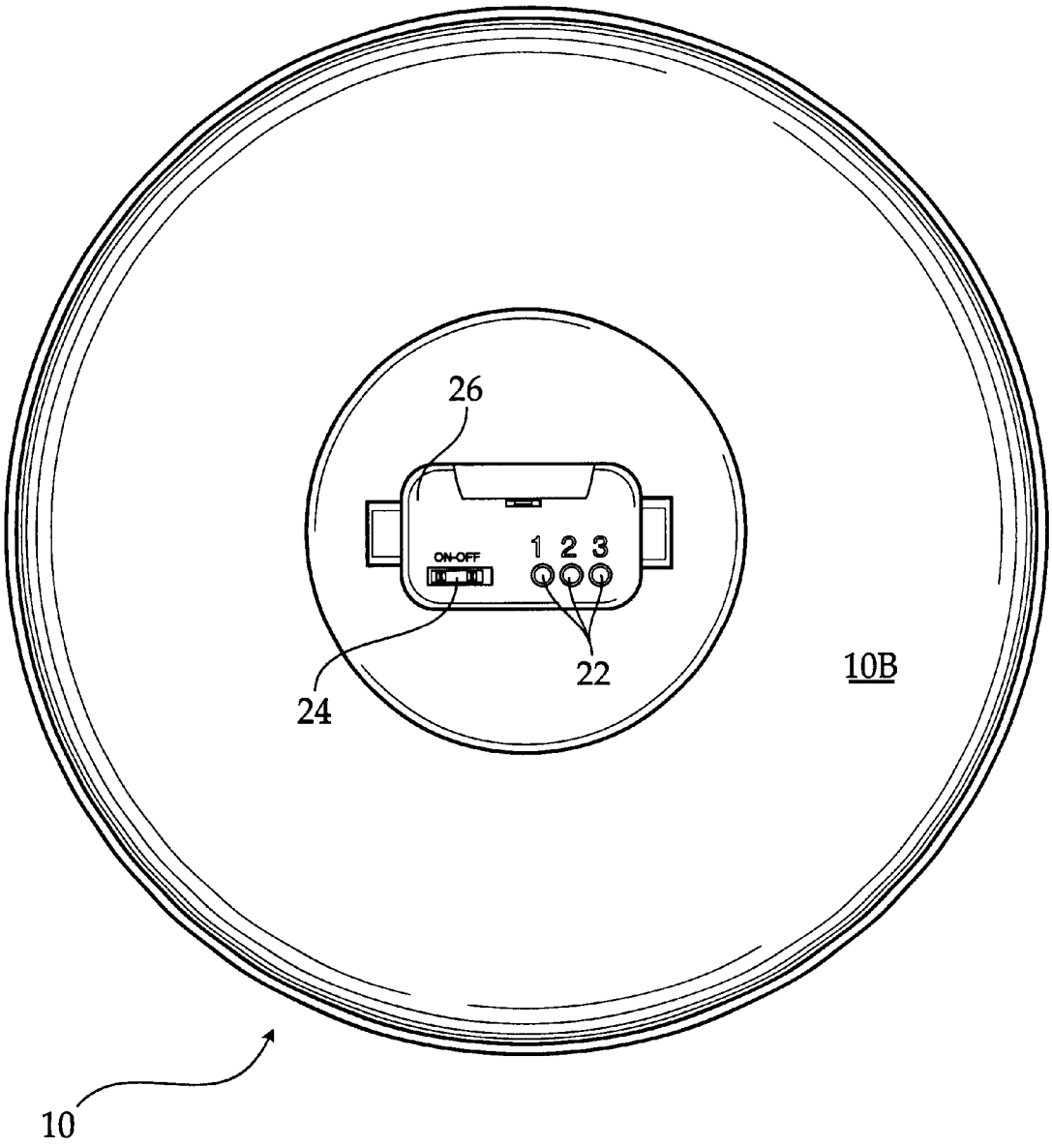
FIG. 2 is a bottom view of the invention which illustrates where the batteries and control unit are located, the placement of the on/off switch, and the placement of the mode selector which allows the user to choose between three different settings for the light display.

FIG. 2 illustrates a bottom view of the invention 10 showing a bottom surface 10B of the disk 10. As illustrated, the battery housing unit 26 is centrally located on the bottom surface 10B. An on/off switch 24 is located on the battery housing unit 26. Also on the battery housing unit 26 is a mode selector 22, which allows a choice between three settings for the lighting display system, and can employ three separate pushbuttons as illustrated, or a three position switch, or any other suitable switching device capable of selecting three different modes. The settings include a first setting which provides for constant emission of light from all the individual bulbs 11 on all rings at the same time, and thus generally at all times; a second setting which provides for a lighting effect which entails successive lighting of adjacent individual bulbs 11 located on each ring of the disk 10, thereby imparting an illusion of motion of light around the ring; and a third setting wherein at least two of the rings of lights are alternately illuminated. With regard to the third setting, preferably all individual bulbs on the third ring of lights 16 are illuminated, then all individual bulbs on the second ring of lights 14 are illuminated, and then all individual bulbs on the first ring of lights 12 are illuminated—providing a "shrinking ring" motion effect.

Figure 3:
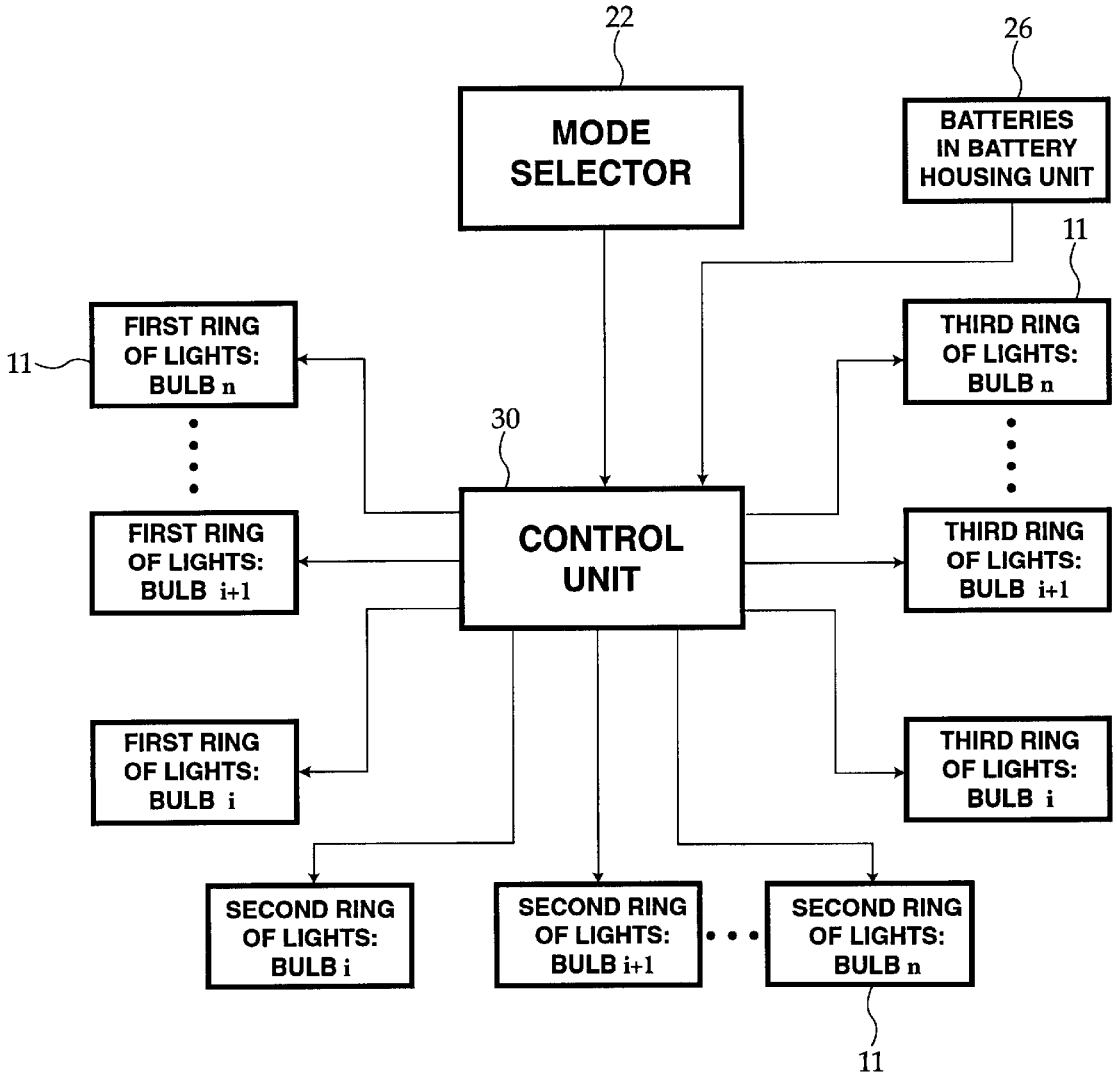
FIG. 3 is a block diagram of the electrical components of the invention.

FIG. 3 is a block diagram illustrating interconnection of various electrical components of the invention. In particular, batteries are located in the battery housing unit 26 which supply power to the control unit 30. The control unit 30 selectively supplies power to the individual bulbs 11 to provide the desired functionality, described above, which pertains to the current setting of the mode selector 22. Accordingly, the control unit 30 is connected to the mode selector 22, and is connected to the individual light bulbs 11. As illustrated and previously described, each ring has numerous individual bulbs. Considering that each ring has "n" individual bulbs 11, the individual bulbs may be labeled as "i" through "n", wherein adjacent bulbs are sequentially numbered. Thus, in FIG. 3, it is shown that individual bulbs "i" through "n" of the first ring 12, second ring 14, and third ring 16 are all connected to the control unit. Accordingly, when in the second setting, the control unit will sequentially illuminate individual bulb "i" of each ring, then individual bulb "i+1", continually incrementing the same until bulb "n" is illuminated and extinguished. Then, said sequence is repeated by the control unit 30. With regard to the first and third settings, bulbs "i" through "n" are illuminated simultaneously.

When playing with the disk 10, if it is desired to have lighting effects, one simply turns the on/off switch to the "on" position, and then chooses one of the settings by suitably operating the mode selector to enable the desired setting which dictates the lighting effect. The flying disk is then tossed, thrown, or hurled as one would use any standard flying disk.

In conclusion, herein is presented an illuminated flying disk which has rings of controllable battery operated lights on its upper surface which may be illuminated in various configurations to allows the disk to be easily seen and played with even when it is dark outside. The invention is illustrated by example in the drawing figures, and throughout the written description. It should be understood that numerous variations are possible, while adhering to the inventive concept. Such variations are contemplated as being a part of the present invention.

What is claimed is:

1. An illuminated flying disk, comprising:

a disk, circular in shape, having a center and a periphery, a top surface and a bottom surface;

a plurality of individual light bulbs located on the top surface of the disk, the individual light bulbs arranged in at least one ring concentric with the periphery, the individual lights are powered by batteries located in a battery housing unit associated with the disk, and with an on/off switch for selectively illuminating the light bulbs wherein the individual light bulbs are arranged in more than one concentric ring, and wherein each of said rings is separately illuminable.

2. The flying disk as recited in claim 1, further comprising a control unit, capable of separately illuminating each of the individual light bulbs.

3. The flying disk as recited in claim 2, further comprising a mode selector in communication with the control unit, which allows a choice between one of three lighting effects comprising:

a) a first setting which when selected illuminates all individual bulbs at the same time;

b) a second setting which when selected illuminates adjacent individual bulbs of each ring sequentially, thereby imparting an illusion of motion of light around the ring; and c) a third setting which when selected allows for alternate flashing between the rings of lights.

4. The flying disk as recited in claim 3, wherein the individual bulbs are arranged in three concentric rings, including a first ring nearest the center of the disk, a second ring outside the first ring, and a third ring closest to the periphery of the disk.

5. The flying disk as recited in claim 4, wherein when the third setting is selected, the third ring is illuminated, then the second ring is illuminated, then the first ring is illuminated.

* * * * *